US006478270B2

(12) United States Patent
Parisi et al.

(10) Patent No.: US 6,478,270 B2
(45) Date of Patent: Nov. 12, 2002

(54) FOOT SUPPORT

(75) Inventors: Bernard Parisi, Barnegat, NJ (US); David J. Burke, Brick, NJ (US)

(73) Assignee: Component Hardware Group, Inc., Lakewood, NJ (US)

( * ) Notice: Subject to any disclaimer, the term of this patent is extended or adjusted under 35 U.S.C. 154(b) by 0 days.

(21) Appl. No.: 09/752,927

(22) Filed: Jan. 2, 2001

(65) Prior Publication Data

US 2002/0084390 A1 Jul. 4, 2002

(51) Int. Cl.[7] ..... F16M 11/24

(52) U.S. Cl. ..... 248/188.8; 248/188.9; 248/188.91; 16/32; 16/42 T

(58) Field of Search ..... 248/188.4, 188.8, 248/188.9, 188.91, 650; 16/32, 42 T

(56) References Cited

U.S. PATENT DOCUMENTS 3,191,212 A * 6/1965 Reiss, Sr. et al. ..... 16/42 R
4,313,586 A * 2/1982 Grzesnikowski ..... 248/188.4
5,040,758 A * 8/1991 Giovannetti ..... 248/188.4
5,169,259 A * 12/1992 Cornell, Jr. et al. ..... 403/309
5,502,852 A * 4/1996 Fredman et al. ..... 248/188.4
5,536,068 A * 7/1996 Valentor et al. ..... 297/344.18
5,894,614 A * 4/1999 Stroud ..... 5/200.1
6,015,190 A * 1/2000 Wend ..... 297/378.1
6,027,086 A * 2/2000 Heitlinger et al. ..... 248/188.5
6,055,704 A * 5/2000 Leibman ..... 16/35 R
6,196,505 B1 * 3/2001 Wainwright ..... 248/188.1
6,216,289 B1 * 4/2001 Woods ..... 5/200.1

* cited by examiner

*Primary Examiner*—Korie Chan
*Assistant Examiner*—Deborah M. Brann
(74) *Attorney, Agent, or Firm*—Francis C. Hand; Carella, Byrne, Bain et al.

(57) ABSTRACT

The adjustable foot support has an internally threaded plastic housing and an externally threaded plastic tubular toe which is threaded into the housing. The two plastic components serve to transfer the weight of the table or cabinet to a support surface. A sleeve of a stainless steel and a collar of stainless steel or similar material are placed about the tubular toe and the plastic housing to present exposed surfaces.

11 Claims, 1 Drawing Sheet

FOOT SUPPORT

Figure 1:
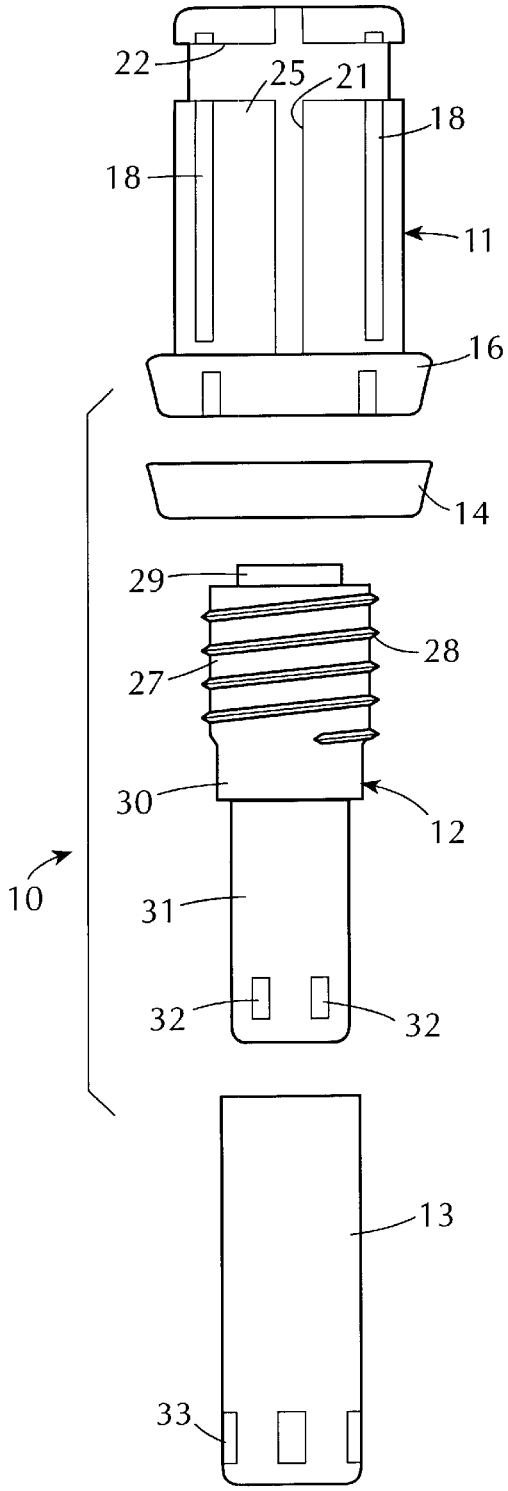

This invention relates to a foot support. More particularly, this invention relates to a foot support for an item such as a leg of a table, cabinet or the like.

Heretofore, various types of foot supports have been manufactured for installation in items, such as a leg of a table, a cabinet, or the like, in order to support the items in an elevated manner on a support surface when used in an environment, such as a commercial kitchen, where the surfaces on which the foot supports rest are exposed to corrosive materials and require frequent cleaning, the foot supports have been made of materials, such as stainless steel, to resist corrosion and to allow frequent cleaning without losing an aesthetically pleasing appearance. However, such foot supports have become relatively expensive to manufacture and are relatively heavy.

It is also known to make the foot supports of adjustable components so that one component may be secured within the item to be supported while another component is threaded into the first component to support the item on a support surface while being exposed to being manually rotated. Rotation of the exposed component allows the supported item to be raised or lowered relative to the support surface.

Foot supports have also been known which are made solely of plastic components in order to reduce the cost of manufacture. However, the exposed components are subject to wear and damage over time due to impacts from cleaning devices and machines and may not present a sterile appearance.

In many cases, the foot supports have been subjected to relatively heavy static loads. For example, the foot supports have been used to support relatively heavy tables as well as the weight of heavy objects placed on the tables. Also, the foot supports have been subjected to impact forces, such as from heavy objects being dropped on the tables, or from movements of the tables across a floor or from the tables being lifted and dropped. In cases where the foot supports have been made of plastic, the plastic parts of the foot support may fail by shattering under the impact forces. Accordingly, plastic foot supports made of plastic have a lower load rating than metal foot supports. For example, a metal foot support may have a rating in excess of 1,000 pounds while plastic foot supports usually have a load rating of no more than 200 pounds.

Accordingly, it is an object of the invention to provide a foot support of light weight construction for use in supporting an item in a corrosive environment.

It is another object of the invention to reduce the cost of fabricating a foot support construction with an aesthetically pleasing appearance.

It is another object of the invention to provide a foot support of plastic load-bearing elements capable of resisting large static loads and impact loads.

It is another object of the invention to provide a plastic foot support with a high load rating.

Briefly, the invention provides an adjustable foot support which is comprised of a hollow plastic housing having an internally threaded bore and a plastic tubular toe having an external thread mating with the internally threaded bore of the housing for adjustable movement of the toe relative to the housing. The construction is such that the plastic housing may be mounted in an item, such as the base of a cabinet or the bottom of a leg of a table to receive the weight of the item while the tubular toe receives the weight of the item via the mating threads of the housing and toe.

The plastic housing and toe are made of different materials to enhance structural load capabilities of each part. The housing is made of a material that is able to withstand a large static load to improve the strength of its thin wall sections. Conversely, since the structure and the shape of the toe provide for large static load capabilities, the toe is made of a material to improve the impact characteristics of the part. The housing is made of a homopolymer polypropylene and the toe is made of a copolymer polypropylene. This allows a completely assembled foot to support both higher static loads and impact forces than are typically found in existing plastic foot assemblies. Overall, the foot support is constructed to have a rating of 1,000 pounds.

The tubular toe is easily rotated within the plastic housing to permit vertical adjustments of the supported item relative to a floor or other support surface on which the tubular foot rests.

The invention further provides a metal sleeve, for example, of stainless steel which is disposed over the tubular toe and extends to the external thread on the toe so as to be received within the plastic housing when in use. This sleeve provides a non-corrosive surface to the outside of the toe and presents an appearance that the entire foot support is made of metal. In addition, should the sleeve become damaged over time, the sleeve may be removed and replaced with a new sleeve without having to replace the tubular toe.

The invention also provides a metal collar, for example of stainless steel, which is secured to the lower end of the housing and is disposed about the metal sleeve on the tubular toe to retain the toe in the housing. When the foot support is mounted in an item to be supported, only the metal collar and the metal sleeve are exposed to view. Thus, the appearance of the support foot is that of a metal support foot. In addition, when using a metal, such as stainless steel, the foot support may be readily cleaned without corroding, particularly in commercial kitchen environments.

By using plastic components, the cost of manufacturing the foot support can be reduced. In addition, the use of plastic components reduces the overall weight of the foot support.

Figure 2:
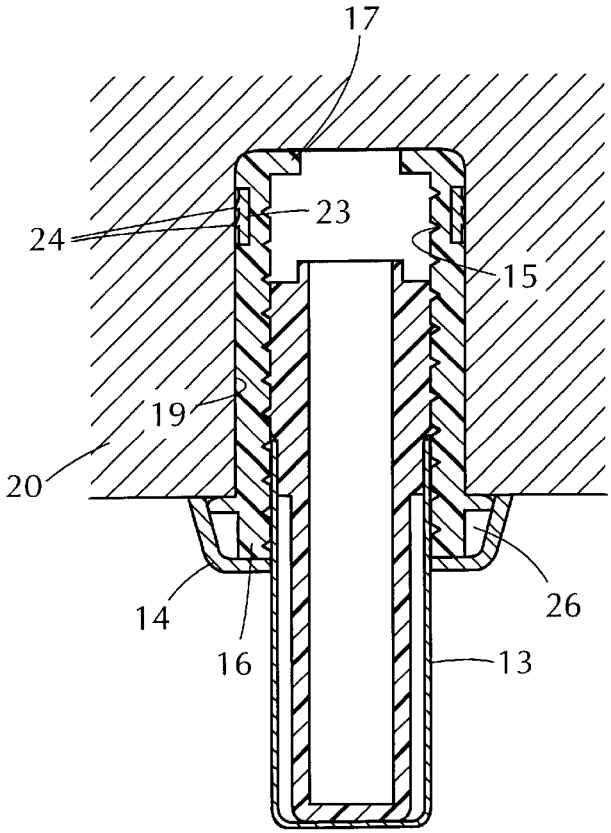

These and other objects and advantages of the invention will become more apparent from the following detailed description taken in conjunction with the accompanying drawings wherein:

FIG. 1 illustrates an exploded view of a foot support in accordance with the invention; and FIG. 2 illustrates the adjustable foot support of FIG. 1 mounted in a base of a cabinet in accordance with the invention.

Referring to FIG. 1, the adjustable foot support 10 is comprised of a hollow plastic housing 11, a plastic tubular toe 12, a metal sleeve 13 and a metal collar 14.

The plastic housing 11 has an internally threaded bore 15 and is particularly made of tubular construction. The threaded bore 15 extends from one end to the opposite end of the housing 11. In addition, the lower end of the housing 11 is provided with a radially outwardly directed collar 16 having a rounded contour for purposes as described below. The opposite end of the housing 11 is provided with a radiantly inwardly directed annular lip 17 which acts as a stop to prevent threading of the tubular foot 12 out of the end of the housing 11.

The outer surface of the housing 11 is provided with a plurality of longitudinally disposed ribs 18 for frictionally engaging in a cylindrical bore 19, for example, in a base of a cabinet 20 as shown in FIG. 2. These ribs 18 serve to securely hold the housing 11 within the cabinet 20.

The outer surface of the housing 11 is also provided with a plurality of longitudinal grooves 21 which are equi-spaced circumferentially of the housing 11 and intersecting circumferential groove 22 near an upper end of the housing 11 as viewed in FIG. 1 which is to receive an optional securing ring 23 as illustrated in FIG. 2.

The securing ring 23 is a split ring which has a plurality of resilient detents or tangs 24 which project outwardly and downwardly, as viewed in FIG. 2, so that upon insertion of the plastic housing 11 into the base of a cabinet 20, the tangs 24 (which are resilient) flex inwardly. Once the housing 11 is seated in place, the tangs 24 to resist withdrawal from the housing 11 by penetrating into the base.

The longitudinal grooves 21 are separated by raised lands 25 on the housing 11. These lands 25 are slidably mounted in the base of the cabinet 20 and are able to compensate for any out-of-roundness in the bore 19 into which the housing 11 is inserted.

The collar 16 at the lower end of the housing 11, as viewed, is provided with a plurality of circumferentially spaced apart slots 26 which allow for a reduction in the amount of material used to manufacture the housing 11.

The tubular toe 12 has an open upper end and a closed lower end as viewed in FIG. 1. In addition, the tubular toe 12 has a first portion 27 with an external thread 28 for mating with the threaded bore 15 in the plastic housing 11 for adjustable movement of the toe 12 relative to the housing 11.

The upper end of the tubular toe 12 has a reduced neck 29 which is of a diameter to fit within the diameter of the lip 17 of the housing 11 while the external thread 28 is of a larger diameter than the internal diameter of the lip 17 so that the lip 17 is able to act as a stop against the external thread 28 to prevent the toe 12 from being threaded through the upper end of the housing 11.

The tubular toe 12 has an annular shoulder 30 adjacent to the externally threaded portion 27 which is of an outer diameter less than the outer diameter of the external thread 28. In addition, the toe 12 has a cylindrical portion 31 disposed adjacent to the annular shoulder 30 which is of an outer diameter less than the outer diameter of the shoulder 30. This cylindrical portion 31 is provided with a plurality of circumferentially disposed flats or depressions 32 at the lower end.

When the tubular toe 12 is threaded into the housing 11, the external thread 28 is hidden from view.

The metal sleeve 13 is made of a stainless steel or other suitable material which can be easily cleaned and which is not readily corrodible, for example in a commercial kitchen environment.

The sleeve 13 has an internal diameter to be slidably disposed over the toe 12 and to be press-fitted onto the annular shoulder 30 of the tubular toe 12. The sleeve 13 is of a length to butt against the tubular toe 12 at the closed end and to extend to the external thread 28 of the tubular foot 12 as illustrated in FIG. 2. As shown in FIG. 2, the metal sleeve 13 is concentrically spaced about the reduced diameter cylindrical portion 31 of the tubular foot 12.

As shown in FIG. 1, the metal sleeve 13 is provided with flats or depressions 33 which are circumferentially spaced about the lower end and which serve to cooperate with the depressions or flats 32 on the tubular toe 11.

As shown in FIG. 2, when the tubular toe 12 is threaded into the housing 11, the metal sleeve 13 projects into the housing 11 so that only the metal sleeve 13 is exposed to view and not the plastic tubular toe 11.

The metal collar 14 is made of stainless steel or other metal similar to that of the sleeve 13 so as to be readily cleanable without being corroded. As shown in FIG. 2, the metal collar 14 is mounted over the annular collar 16 of the plastic housing 11 to be concentrically disposed about the metal sleeve 13. This collar 14 may be secured in place be crimping over the back side of the plastic collar 16, as viewed. The collar 14 has an inner diameter less than the outer diameter of the external thread 28 of the toe 12 to retain the toe 12 in the housing 11.

In order to assemble the foot support 10, the metal sleeve 13 is slid over the tubular toe 12 and pressed fitted onto the annular shoulder 30. The sleeve 13 is pushed onto the shoulder 30 until the closed end of the sleeve 13 butts against the closed end of the tubular toe 12.

Next, the tubular toe 12 is threaded into the housing 11 to a desired point with the external thread 28 completely within the housing 11. If the metal sleeve 13 has not been previously placed on the tubular toe 12, the metal sleeve 13 may now be put into place.

Thereafter, the collar 14 is slid over the metal sleeve 13 and mounted on the annular collar 16 of the housing 11 in a secure manner. The collar 14 thus prevents the toe 12 from being threaded out of the housing from that end.

Once the foot support 10 is assembled, the plastic housing 11 is pressed into the bore 19 of the cabinet base 20 in a friction fit manner.

In use, the weight of the cabinet 20 is transferred into the plastic housing 11 and then to the tubular toe 12 via the mating threads 15,28. The weight of the cabinet is then transferred from the plastic tubular toe 12 onto the closed end wall of the metal sleeve 13 and then to the support surface or floor on which the support foot 10 rests. The metal sleeve 13 does not provide any weight bearing function.

The housing 11 has thin wall sections and is thus made of a material, such as a homopolymer polypropylene, which is able to withstand a large static load and, thereby improve the strength of the thin wall sections. The toe 12 is made of a material to improve its impact characteristics, for example, being made of a copolymer polypropylene. The dimensions of the housing 11 and toe 12 are such that the foot support 10 is rated to carry 1,000 pounds of force. By way of example, the housing 11 has a length of 2⅜ inches, an outside diameter of 1⅜ inches and an inside diameter of 1 inch; the collar 16 has an outside diameter of 1½ inches; the toe 12 has a length of 3 5/16 inches, an outside diameter of ⅞ inches in the cylindrical portion 31, and an inside diameter of 9/16 inches.

Should it become necessary to make a height adjustment of the cabinet 20, the tubular foot 12 is rotated into or out of the fixed housing 11 to the extent desired so as to lower or raise the cabinet 20.

The plastic housing 11 and plastic tubular toe 12 may be readily molded using conventional molding techniques. Since the parts are made of plastic, they are of relatively light weight.

In another embodiment, the metal sleeve 13 may be provided with a solid annular flange (not shown) at the base in order to increase the bearing surface through which a load is transferred onto the support surface.

The invention thus provides an adjustable foot support which can be made in an economical manner. Further, the invention provides an adjustable foot support which can be made of inexpensive materials but which provides the appearance of a stainless steel structure.

The invention further provides an adjustable foot support which can be used for supporting table legs, cabinet bases and the like in environments which require frequent cleaning and exposure to cleaning solutions without corrosion of the exposed parts of the foot support.

The invention also provides a foot support of all plastic load-carrying elements which provide a high load rating relative to static loads and impact loads.

What is claimed is:

1. An adjustable foot support comprising a hollow plastic housing having an internally threaded bore;

a plastic tubular toe having a first portion with an external thread mating with said threaded bore for adjustable movement of said toe relative to said housing;

a metal sleeve slidably disposed over said toe and extending to said threaded portion; and a metal collar mounted on said housing and disposed about said metal sleeve.

2. A foot support as set forth in claim 1 wherein said toe includes an annular shoulder adjacent said external thread of an outer diameter less than the outer diameter of said external thread and a cylindrical portion adjacent said annular shoulder of an outer diameter less than said outer diameter of said shoulder.

3. A foot support as set forth in claim 2 wherein said metal sleeve is press-fitted onto said annular shoulder of said plastic toe.

4. A foot support as set forth in claim 3 wherein said toe has a terminal annular portion with a plurality of flats thereon and said metal sleeve has a terminal annular portion with a plurality of flats mating with said terminal portion of said toe.

5. A foot support as set forth in claim 4 wherein said metal sleeve has a transverse wall at one end of said terminal annular portion.

6. A foot support as set forth in claim 1 wherein said housing has a plurality of longitudinally disposed ribs for frictionally engaging in a cylindrical bore.

7. A foot support as set forth in claim 1 wherein said housing has a radially inwardly directed annular lip to prevent threading of said toe past said lip and out of said housing.

8. A foot support as set forth in claim 1 wherein said metal collar has an inside diameter less than an outer diameter of said external thread on said toe to retain said toe in said housing.

9. A foot support as set forth in claim 1 wherein said plastic housing is made of homopolymer polypropylene and said plastic toe is made of a copolymer polypropylene.

10. An adjustable foot support comprising a hollow plastic housing having an internally threaded bore and being made of a material resistant to a predetermined static load and a predetermined impact load;

a plastic tubular toe having a first portion with an external thread mating with said threaded bore for adjustable movement of said toe relative to said housing, an annular shoulder adjacent said external thread of an outer diameter less than the outer diameter of said external thread and a cylindrical portion adjacent said annular shoulder of an outer diameter less than said outer diameter of said shoulder, said toe being made of a material having a resistance to a static load equal to that of said housing and a resistance to an impact load less than said predetermined impact load; and a metal sleeve press-fitted onto said annular shoulder of said toe.

11. A foot support as set forth in claim 10 which further comprises a metal collar mounted on said housing and disposed about said toe, said collar having an inner diameter less than an outer diameter of said thread on said toe to retain said toe in said housing.

* * * * *